US005348031A

United States Patent [19]

Cloud

[11] Patent Number: 5,348,031

[45] Date of Patent: Sep. 20, 1994

[54] COSMETIC APPARATUS

[76] Inventor: Linda D. Cloud, 202 Village Way, Brick, N.J. 08724

[21] Appl. No.: 123,056

[22] Filed: Sep. 20, 1993

[51] Int. Cl.[5] ..... A45D 40/24

[52] U.S. Cl. ..... 132/317; 132/294; 132/295; 132/320; 206/581; 206/823

[58] Field of Search ..... 132/294, 295, 296, 297, 132/314, 315, 317, 318, 320; 206/581, 823; 401/191

[56] References Cited

U.S. PATENT DOCUMENTS

| | | | |
|---|---|---|---|
| 1,485,722 | 3/1924 | Schramm | 401/191 |
| 2,557,141 | 6/1951 | Rebora | 132/294 |
| 4,739,778 | 4/1988 | Christe | 132/88.7 |
| 4,824,143 | 4/1989 | Grainger | 283/56 |
| 4,876,136 | 10/1989 | Chang et al. | 428/130 |
| 4,884,719 | 12/1989 | Levine et al. | 221/25 |
| 4,890,872 | 1/1990 | Parrotta et al. | 132/317 |
| 4,998,621 | 3/1991 | Meehan | 206/466 |
| 5,031,647 | 7/1991 | Seidler | 132/320 |
| 5,109,879 | 5/1992 | Seidler | 132/320 |

*Primary Examiner*—Gene Mancene
*Assistant Examiner*—Frank A. LaViola
*Attorney, Agent, or Firm*—R. Gale Rhodes, Jr.

[57] ABSTRACT

Combination compact and cosmetic applicator to which a quantity of cosmetic is affixed. The compact may be closed to contain and protect the applicator and cosmetic from the ambient and the compact may be easily opened to permit the applicator to be readily used to apply the cosmetic to a person.

5 Claims, 2 Drawing Sheets

COSMETIC APPARATUS

BACKGROUND OF THE INVENTION

This invention relates generally to new and improved cosmetic apparatus for containing and applying a cosmetic, such as for example, lipstick, blushes, eye liner and eye shadow, treatment lotions such as a moisturizer, and foundations. More particularly, this invention relates to a one-piece combination compact and cosmetic applicator which can contain from one day to 30 days supply of some cosmetics and which is sufficiently simple and inexpensive to manufacture that it can function, if desired, as a cosmetic sampler or even as a single-sample cosmetic dispenser.

Numerous cosmetic apparatus such as cosmetic dispensers, compacts and cosmetic applicators are known to the art. In addition, numerous cosmetic samplers or one-sample cosmetic dispensers are known to the art and are typically used at a cosmetic counter in a store for introducing a new cosmetic such as for example a new lipstick color. Such cosmetic samplers are experiencing increased usage and desirability due to the increasing concern about the transmission of diseases, such as AIDS, between people. It has been the practice, for example, at cosmetic or lipstick counters, to provide a tube of new lipstick for use by several ladies to experiment with the new lipstick or lipstick color as a try-out before the new lipstick is purchased. This sharing Of a new lipstick color has been largely discontinued due to the above mentioned increasing awareness and concern about disease transmission.

Accordingly, there exists a need in the cosmetic art for new and improved cosmetic apparatus for containing or storing a limited quantity of cosmetic and which includes an applicator for conveniently applying cosmetic to a person such as for conveniently applying a new lipstick sample to the lips of a single person. For eye catching appeal there is a need for such cosmetic apparatus to be visually attractive or have considerable aesthetic appeal at the cosmetic counter or point of potential purchase.

SUMMARY OF THE INVENTION

It is the object of this invention to satisfy the foregoing needs in the cosmetic art.

Cosmetic apparatus satisfying the foregoing need and embodying the present invention may include a combination compact and cosmetic applicator for having a quantity of cosmetic affixed thereto and which compact may be closed to contain the applicator and cosmetic and substantially protect the cosmetic from the ambient and which compact may be easily and conveniently opened to permit the applicator to be easily and readily used to apply the cosmetic to a person.

DESCRIPTION OF THE PREFERRED EMBODIMENT

Figure 1:
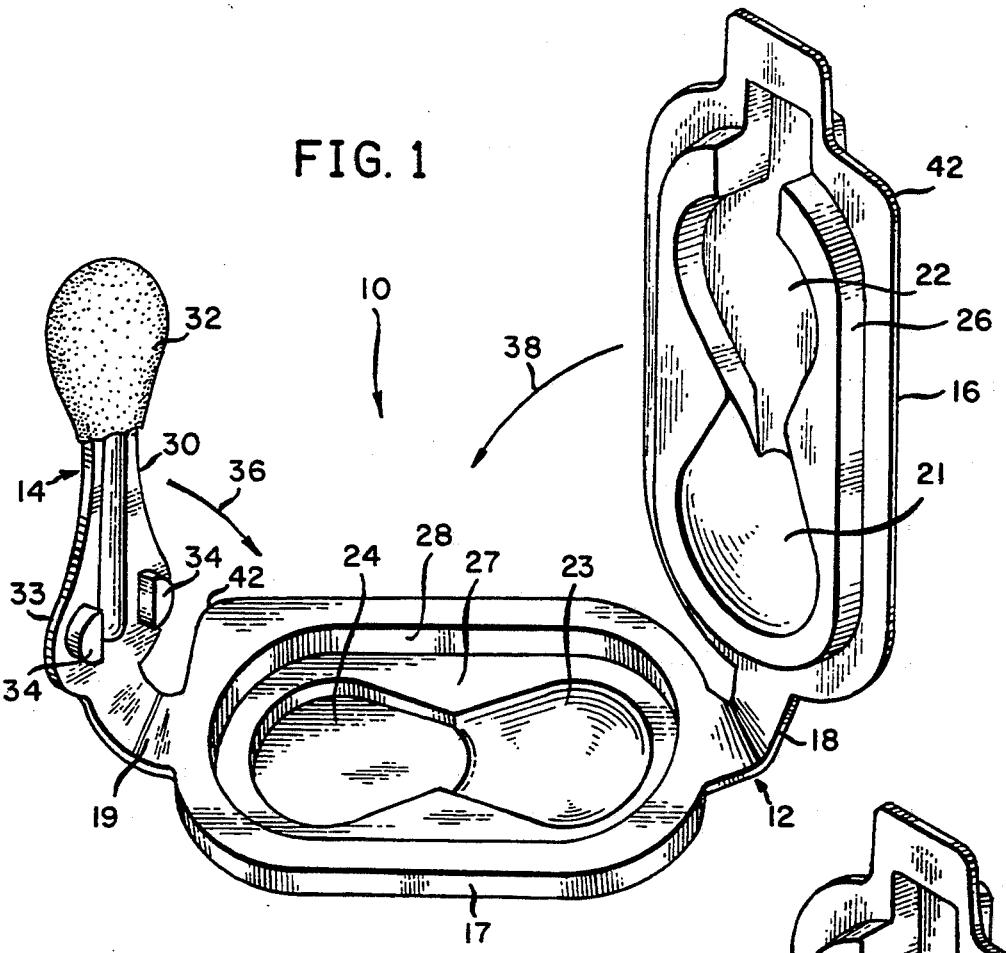
FIG. 1 is a perspective generally diagrammatical view showing the cosmetic apparatus of the present invention in the open position.

Referring now to FIG. 1, there is shown cosmetic apparatus indicated by general numerical designation 10 embodying the present invention. Apparatus 10 comprises a one-piece combination clamshell or clamshell-like compact indicated by general numerical designation 12 and a cosmetic applicator indicated by general numerical designation 14. Compact 12 includes a pair of clamshell or clamshell-like members 16 and 17 hinged together as indicated diagrammatically by the dashed line 18 in FIG. 1. The members 16 and 17 bend or fold towards and away from each other about the hinge or bendable portion 18. The applicator 14 bends toward and away from the clamshell compact member 17 about the hinge or bendable portion 19.

The clamshell compact members 16 and 17 are provided with a pair of recesses or outwardly extending portions which are placed in opposition to each other when the compact member 16, for example, is pivoted or bent or folded towards and placed into engagement with the compact member 17. More particularly, the member 16 is provided with a first recess or outwardly extending portion 21 and a second recess or outwardly extending portion 22 and the member 17 is provided with a first recess or outwardly extending portion 23 and a second recess or outwardly extending portion 24. To interconnect the clamshell compact members 16 and 17 together to form the compact 12 the member 16 is provided with an outwardly extending ridge 26 surrounding the recesses 21 and 22 and the clamshell compact member 17 is provided with an inwardly extending recess 27 surrounding the recesses 23 and 24 and which recess 27 is defined by an inwardly extending recess wall 28. It will be understood that the ridge 26 and recess wall 28 are complementary in shape and designed to have a slight interference fit to provide a temporary snap-fit between the clamshell compact members 16 and 17 upon the member 16 being pivoted towards the member 17 about the hinge or bendable portion 18 and into snap-fit engagement therewith.

The cosmetic applicator 14 includes a stem or shank portion 30 having a quantity of cosmetic 32, such as lipstick, suitably affixed to its outer end and an enlarged portion 33 provided with a pair of outwardly extending spacers or spacing members 34—34. For closure of the compact 12, the applicator 14 is pivoted about the hinge 19 towards the clamshell compact member 27 as indicated by the arrow 36 in FIG. 1 until the applicator 14 occupies the position shown in FIG. 2 at which time the spacers or spacing members 34—34, shown in dashed outline in FIG. 2, engage the surface of the recess 24 whereupon the applicator 14 resides generally parallel with respect to the clamshell compact member 17 with the cosmetic 32 residing in but spaced from the surface of the recess 23. The spacers 34—34 are provided with the height or length which assures that the cosmetic 32 will not touch or engage the surface of the recess 23 to prevent smearing or damage to the cosmetic. The clamshell compact member 16 is then pivoted about the hinge 18 towards the clamshell compact member 17 in the direction of the arrow 38 in FIG. 1 to cause the ridge 26 to engage the recess wall 28 in an interference or snap-fit engagement to temporarily interconnect or snap-fit the clamshell compact members 16 and 17 to provide a compact for containing the applicator 14 and in particular the cosmetic 32 and protect the cosmetic, at least substantially, against the ambient or surrounding environment and in particular dust, dirt, and other undesirable airborne particles. Since it will be understood that upon the clamshell compact members 16 and 17 being interconnected or snap-fitted together as described, the recesses 21 and 23 are placed in opposition and cooperatively provide a cavity or compartment for receiving the cosmetic 32 spaced from the surfaces defining these recesses and that the recesses 22 and 24 are placed in opposition to provide a cavity or compartment for receiving the enlarged portion 33 of the cosmetic applicator 14. It will be understood that the shape of the recesses 22 and 24 and the shape of the enlarged portion 33 of the applicator 14 are both functional and decorative in that they may be designed to have almost any shape or configuration other than the circular or spherical shape shown so as to provide additional visual attractiveness or aesthetic appeal.

Figure 3:
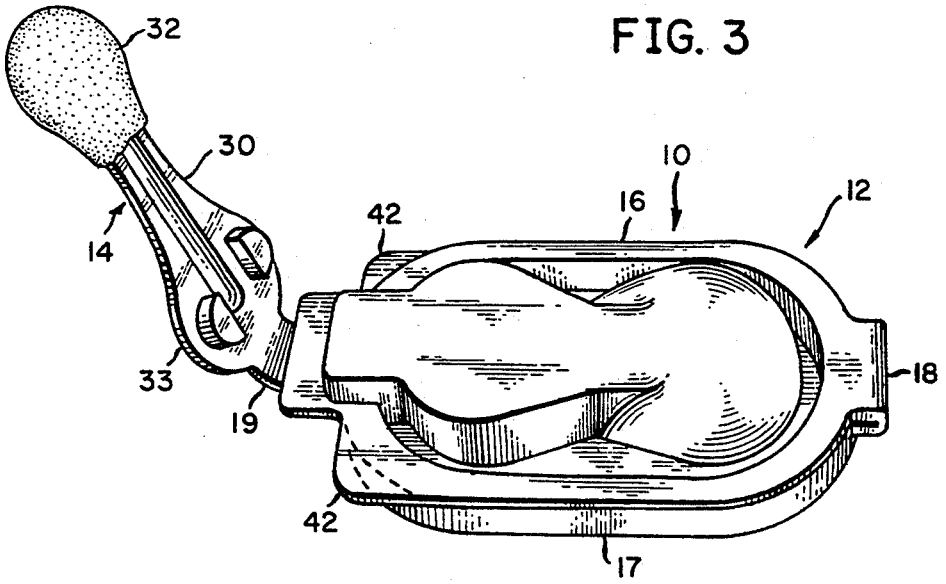
FIG. 3 is a perspective generally diagrammatical view showing the compact apparatus of the present invention with the compact shown in the closed position functioning as a handle for the outwardly extending cosmetic applicator having a quantity of cosmetic affixed thereto.

To open the compact 12 after clamshell compact members 16 and 17 have been snap-fitted together as described above, the members 16 and 17 may be provided, respectively, with corners or ear flap portions 41 and 42 which extend outwardly or beyond the body portions of the clamshell members 16 and 17, particularly as shown in FIG. 3, and which corners or ear flap portions facilitate unsnapping or prying apart of the clamshell compact members 16 and 17 to separate the ridge 26 from the recess wall 28 and thereby open the clamshell compact members.

Figure 2:
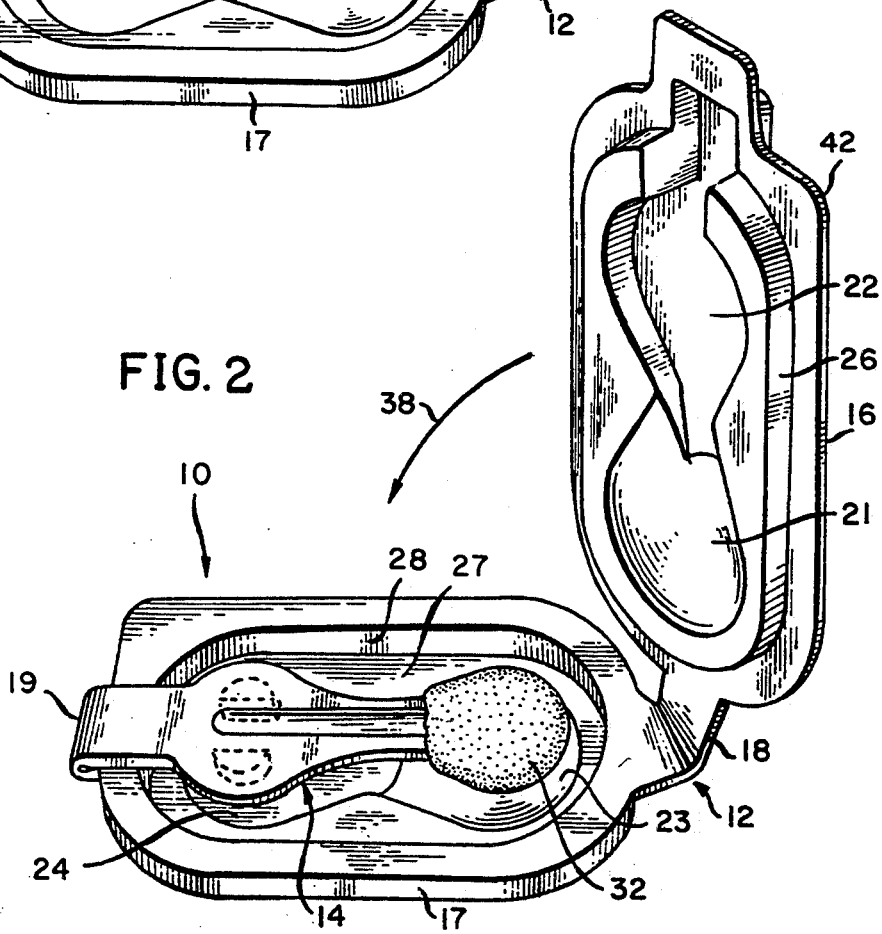
FIG. 2 is a perspective view showing the apparatus of FIG. 1 with the compact comprising members open and with the applicator shown folded or bent over one of the compact members.

It will be further understood that upon the clamshell compact members 16 and 17 comprising the compact 12 being opened as described above, the applicator 14 and cosmetic 32 will occupy the position shown in FIG. 2 and the applicator 14 may be pivoted outwardly, in the direction opposite to that indicated by the arrow 36 in FIG. 1, until the applicator 14 and cosmetic 32 extend outwardly as shown in FIG. 3 whereupon the clamshell compact members 16 and 17 again may be pivoted towards each other and into snap-fit engagement with each other as shown in FIG. 3 at which time the clamshell compact members 16 and 17 provide the compact 12 which can act as a handle for the convenient use of the applicator 14 in applying the cosmetic 32 to a person such as for the convenient application of lipstick to the lips of a female.

Figure 4:
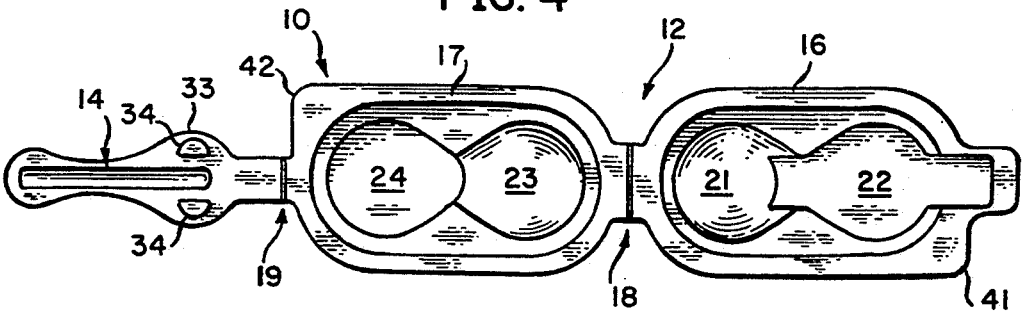
FIG. 4 is a top or plan view of an actual embodiment of cosmetic apparatus embodying the present invention.
Figure 5:
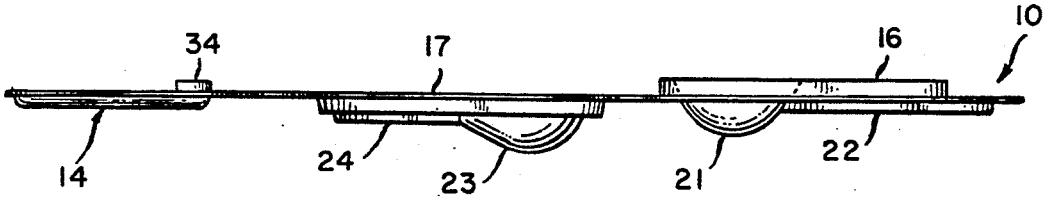
FIG. 5 is a side view of the apparatus shown in FIG. 4.

An actual embodiment of the cosmetic apparatus 10 of the present invention is shown in FIGS. 4 and 5 and may be readily and inexpensively manufactured and provided with the shapes shown in FIGS. 4 and 5 by thermoforming or injection molding using techniques known to the art. The cosmetic apparatus 10 may be suitably and inexpensively made from flexible or plastic transparent material such as PVC, PET or vinyl acetates; PET (polyethylene tetra pthalate) is preferred for aesthetic and environmentally friendly reasons. It will be generally understood that the elements of the cosmetic apparatus 10 described about and shown in FIGS. 1–3 are given the same numerical designations in FIGS. 4 and 5 for convenience of reference and understanding, except that in the actual embodiment shown in FIGS. 4 and 5 the hinges or bendable portions illustrated diagrammatically in FIGS. 1–3 are cut or score lines 26 and 27 extending partially into the plastic material from which the apparatus 10 is made or formed.

The cosmetic apparatus 10 may be formed from a clear plastic or resin of the type noted above to permit the cosmetic 32 to be seen through the clamshell compact members 16 and 17 upon the compact 12 being closed. This is particularly aesthetically pleasing when the cosmetic is a bright shade of lipstick. Alternatively, if the cosmetic apparatus 10 is to be placed inside packaging and not exposed to direct view, the plastic of which the cosmetic apparatus is made may be provided with a color which may be color compatible with the color of the packaging in which the cosmetic apparatus is contained.

The cosmetic 32 may be affixed to the end of the stem of the cosmetic applicator 14 in any one of several manners known to the art, for example, upon the cosmetic 32 being a wax based cosmetic, such as in the case of lipstick, blushes, eyeliner, eyeshadow, and fragrances, the cosmetic may be heated into a slurry and the end of the applicator dipped into the slurry and, in the manner known to the art, due to the difference in temperature between the applicator and the slurry a portion of the slurry will adhere to the applicator upon the applicator being withdrawn and will typically assume a generally spherical shape as indicated in FIG. 1. Upon the cosmetic 32 being a treatment lotion such as a moisturizer or a foundation, absorbent foam may be suitably affixed to the end of the applicator 14, such as by a suitable adhesive, and the foam may be used to absorb the treatment lotion or foundation.

It will be understood that many variations and modifications may be made in the present invention without departing from the spirit and the scope thereof.

What is claimed is:

1. Cosmetic apparatus, comprising:

a pair of pivotally interconnected members, each of said members provided with at least one recess, an applicator for supporting a cosmetic interconnected pivotally to one of said members, said members provided with cooperative interconnecting means, upon said applicator supporting a cosmetic and being pivoted over said one member and upon said members being pivoted towards and into engagement with each other said interconnecting means being engaged to temporarily secure said members to each other and said recesses being placed in opposition to each other and cooperatively providing a compartment for receiving said cosmetic, and upon said interconnecting means being disengaged and said members pivoted away from each other and upon said applicator being pivoted away from and extending outwardly from said one member, said members for being pivoted towards and into engagement with each other and said interconnecting means for being engaged to temporarily secure said members to each other to cause said members to cooperatively provide a handle for using said applicator to apply said cosmetic to a person.

2. Cosmetic apparatus, comprising:

one-piece combination cosmetic compact and cosmetic applicator formed from flexible, transparent plastic material, said compact comprised of a pair of hingedly engageable members bendable toward and into a snap-fit engagement with each other to provide a cavity for receiving said applicator which is formed on one of said members and bendable inwardly towards said members to reside in said cavity and said members bendable away from each other to open said cavity and permit said applicator to bend outwardly and extend from said one member whereupon said members are rebendable towards and into said snap-fit engagement with each other to provide a handle for said applicator.

3. The cosmetic apparatus according to claim 2 wherein said members are provided with outwardly extending corner portions for being engaged and moved generally in opposite directions to facilitate bending said members apart upon being placed in said snap-fit engagement.

4. The cosmetic apparatus according to claim 2 wherein said applicator is provided with at least one outwardly extending spacer for engaging one of said members to position said applicator in said cavity spaced apart from said members.

5. The cosmetic apparatus according to claim 2 wherein said members are provided with pairs of recesses which cooperatively provide a pair of larger recesses which in plan view are shaped generally in the shape of a FIG. 8, and wherein said applicator includes an inner enlarged portion having a shape in plan view complementary to the shape in plan view of one of the recesses formed in the member on which said applicator is formed, and said applicator including an outer portion of reduced size forming a shank portion for receiving a quantity of cosmetic.

* * * * *